United States Patent [19]

Sasaki et al.

[11] Patent Number: 4,969,322

[45] Date of Patent: Nov. 13, 1990

[54] ULTRA-SOFT AND FLAT MULTIFILAMENT YARN AND PROCESS FOR THE PRODUCTION THEREOF

[75] Inventors: Yoshiyuki Sasaki, Takatsuki; Masayuki Tani, Ibaraki, both of Japan

[73] Assignee: Teijin Limited, Osaka, Japan

[21] Appl. No.: 368,345

[22] PCT Filed: Nov. 7, 1988

[86] PCT No.: PCT/JP88/01125

§ 371 Date: Jun. 15, 1989

§ 102(e) Date: Jun. 15, 1989

[87] PCT Pub. No.: WO89/04388

PCT Pub. Date: May 18, 1989

[30] Foreign Application Priority Data

Nov. 6, 1987 [JP] Japan ..... 62-279364

[51] Int. Cl.[5] ..... D02G 3/02; D02G 3/24; D02G 3/38

[52] U.S. Cl. ..... 57/244; 28/156; 57/208; 57/245; 57/288; 57/289; 428/224; 428/229

[58] Field of Search ..... 57/205, 207, 244, 208, 57/245, 287, 288, 289; 28/156, 281; 428/224, 225, 229

[56] References Cited

U.S. PATENT DOCUMENTS

| | | | |
|---|---|---|---|
| 4,145,870 | 3/1979 | Klee et al. | 57/288 |
| 4,170,867 | 10/1979 | Leininger | 57/245 |
| 4,226,079 | 10/1980 | Mountney et al. | 57/288 |
| 4,262,481 | 4/1981 | Otaki et al. | 57/245 |
| 4,307,565 | 12/1981 | Sasaki et al. | 57/288 X |
| 4,365,466 | 12/1982 | Horiuchi et al. | 57/208 X |

OTHER PUBLICATIONS

Japanese Textile Machinary Association (Osaka), "Manual of Filament Processing Technology", vol. 1, (May 31, 1984), pp. 103 to 105.

*Primary Examiner*—John Petrakes

*Attorney, Agent, or Firm*—Burgess, Ryan & Wayne

[57] ABSTRACT

A flat multifilament yarn having a very soft unique touch is obtained by arranging two or more types of multifilament yarns having different drawings properties in parallel, and applying a false twisting procedure which includes a twist applying and twist releasing operations to the paralleled multifilament yarn at a temperature of 120° C. or less, and subjecting the resultant false twisted composite yarn to a heat treatment at a temperature of 130° C. or more in a subsequent procedure, the resultant high elongation multifilaments derived from the high drawability multifilaments in the multifilament yarn having a crystallinity (density method) of 10% to 30%, a non-crystalline portion orientation of 0.035 to 0.10, a non-crystalline portion density of 1.31 to 1.36 g/cm$^3$, and a Young's modulus of 200 to 700 kg/mm$^2$.

41 Claims, 3 Drawing Sheets

ULTRA-SOFT AND FLAT MULTIFILAMENT YARN AND PROCESS FOR THE PRODUCTION THEREOF

TECHNICAL FIELD

The present invention relates to a process for the production of an ultra-soft and flat multifilament yarn which is extremely soft and has a unique touch, and to an ultra-soft and flat multifilament yarn produced by the above process, and an ultra-soft fabric composed of the above-mentioned multifilament yarn.

BACKGROUND ART

Synthetic fibers usually have glass transition temperatures (also called second-order transition temperatures), and at temperatures lower than these temperatures, polymer molecules are frozen and molecular movement becomes difficult. Therefore, when drawing such fibers, usually the drawing temperature is the glass transition point of the fibers or higher and the drawing procedure is carried out in conditions such that the polymer molecules are easily movable. When a synthetic fiber is forcibly drawn while the polymer molecules of the fiber are frozen at the glass transition temperature or lower, however, the polymer molecules will not be oriented, and accordingly, fibers exhibiting a specific touch entirely different from that of the drawn fibers of the prior art are obtained (note, if the frozen polymer molecules are forcibly drawn by the method of the prior art, stretching irregularities will be inevitably formed, and thus a product having a uniform appearance cannot be obtained). Therefore, the drawing of synthetic fibers at a temperature corresponding to the glass transition temperature thereof or lower is the same as that used in the process for production of the Thick & Thin fiber, as also shown in Japanese Patent Publication (Kokoku) No. 58-44762, and accordingly, it is impossible to obtain only a specific touch without generating drawing irregularities. Also, since this drawing at the glass transition point or lower forcibly stretches the frozen polymer molecules, a very strong force is required therefor and thus many problems arise in that slippage of the filaments occurs at peripheral surfaces of the rollers, which leads to fluffs and the generation of laps. Also, a problem arises in that the productivity of the drawn filament yarn is lowered.

DISCLOSURE OF THE INVENTION

The present invention is intended to provide a process for producing an ultra-soft and flat multifilament yarn, which is very soft and has a unique touch, when the polymer molecules are frozen, without changing the cross-sectional profile of the multifilament and without imparting crimps thereto, and to provide an ultra-soft and flat multifilament yarn comprising uniformly drawn multifilaments having a uniform appearance and properties, and an ultra-soft, flat multifilament yarn fabric obtained therefrom.

The process of the present invention for preparing the ultra-soft, flat multifilament yarn comprises applying a false twisting procedure including twist applying and twist releasing operations to two or more types of multifilament yarns having different drawing properties and arranged in parallel with each other, characterized in that the false twisting procedure is carried out at a temperature of 120° C. or lower, and the resultant false twisted composite yarn is subjected to a heat treatment at a temperature of 130° C. or more in a successive procedure carried out thereafter.

In the present invention, the term flat multifilament refers to a straight multifilament having substantially no crimp.

BRIEF DESCRIPTION OF THE DRAWINGS

FIG. 4 (*b*) is a side view illustrating the flat multifilament yarn according to the present invention.

BEST MODE OF CARRYING OUT THE INVENTION

The present invention is described in more detail with reference to specific examples thereof.

Figure 1A:
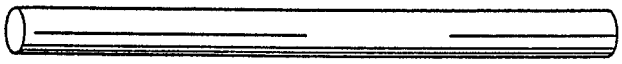
Fig. 1(a) (PRIOR ART)
FIGS. 1 (*a*), (*b*) and (*c*) are side views of synthetic filaments of the prior art illustrating the drawing step of the filaments, wherein FIG. 1 (*a*) shows a side view of an unstretched synthetic filament, FIG. 1 (*b*) shows a side view of a uniformly drawn synthetic filament, and FIG. 1 (*c*) shows a side view of an unevenly stretched synthetic filament.
Figure 1B:
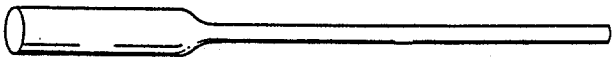
Fig. 1(b) (PRIOR ART)
Figure 1C:
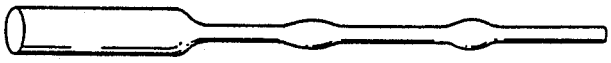
Fig. 1(c) (PRIOR ART)

FIG. 1 (*a*) is a side view of an unstretched synthetic filament. When the unstretched filament is heated to a temperature corresponding to the glass transition point thereof or more, to thaw the polymer molecules, and then drawn by the prior art method, the filament is uniformly drawn as shown in FIG. 1 (*b*). If, however, the filament is drawn at a temperature lower than the glass transition temperature thereof, since the constituent polymer molecules are drawn forcibly while frozen, the filament cannot be uniformly and smoothly drawn, and is drawn nonuniformly as shown in FIG. 1 (*c*) and has an uneven thickness. The "glass transition temperature" as defined herein is measured by the dilatometric method and, for example, in the case of polyesters, is from 79° C. to 8° C.

Figure 2A:
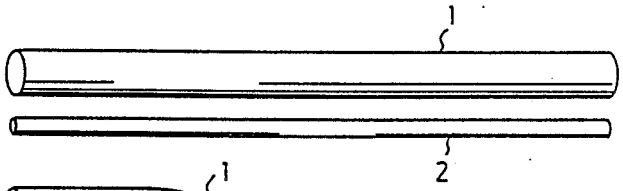
FIGS. 2 (*a*), (*b*) and (*c*) are side views of filament yarns arranged in parallel and comprising two types of synthetic filaments having different drawing properties, illustrating a false twisting procedure for the parallel filament yarns by the process of the present invention, wherein FIG. 2 (*a*) shows a side view of parallel yarns consisting of two types of synthetic filaments, FIG. 2 (*b*) shows a side view of the filament at the initial stage of the false twisting step when the process of the present invention is applied to the parallel yarns shown in FIG. 2 (*a*), and FIG. (*c*) shows a side view showing the yarn formed by the false twisting procedure.
Figure 2B:
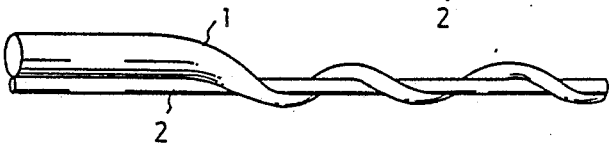
Figure 2C:
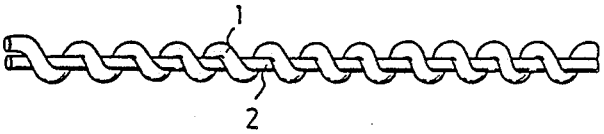

In contrast, FIG. 2 shows the filaments in the false twist-drawing procedure in accordance with the process of the present invention. As shown in FIG. 2 (*a*), when an undrawn filament 1 and an additional filament 2 having a higher orientation than that of the filament 1, and therefore, more difficult to draw than the filament 1, are arranged in parallel, and as shown in FIG. 2 (*b*), drawn while twisting, since the undrawn filament 1 is easily drawable but it is difficult to draw the additional filament 2, the drawn filament 1 is drawn such that it is wound around the additional filament 2 as shown in FIG. 2 (*c*). Accordingly, the undrawn filament 1 is uniformly drawn to a longer length than the additional filament 2, to enable the above-mentioned winding.

More specifically, when both ends of the filament are gripped and the filament is drawn as shown in FIG. 1 (c), particularly at the glass transition point (second order transition point) or lower where the molecules thereof are frozen, it is difficult to draw the filament, and therefore, when the filament is forcibly drawn, the portions of the filament which can be easily drawn are easily elongated, but the other portions which can be elongated only with difficulty are not elongated to the same degree, whereby the resultant drawn filament has an uneven thickness. When the undrawn filament 1 is drawn in the twisting process together with the additional filament 2 as described above to provide a tendril-like form, however, the undrawn filament is gradually elongated at respective portions thereof, and thus uniformly and evenly elongated at respective portions thereof without the local elongation usually generated when both ends of the filament are gripped, and the middle portion of the filament is drawn to form a composite yarn as shown in FIG. 2 (c). Accordingly, in the process of the present invention, the filament can be uniformly drawn by the false twist-drawing procedure at the glass transition temperature thereof or lower, and further, it becomes possible to uniformly draw the filament even at a low draw ratio at which local elongation is usually generated.

Nevertheless, when the filament 1 is wound by twisting, it cannot be elongated to an extent greater than the natural elongation thereof only by such a false twisting, whereby the upper limit of the draw ratio is per se determined. However, when the undrawn filament 1 is wound while drawing the additional filament 2, the total elongation of undrawn filament 1 is the sum of the elongation due to the winding and elongation corresponding to the elongation of the additional filament 2. Also, in this case, the elongation of the undrawn filament 1 is extremely uniform. It is considered that this phenomenon occurs because the undrawn filament 1 is wound firmly around the additional filament 2 and is elongated while being restricted by this form. Accordingly, by controlling the amount of elongation of the additional filament 2, the elongation of the unstretched filament 1 can be increased or decreased as required. Also, if the undrawn filament 1 and the additional filament 2 are first interlaced with each other, and the twisting operation as described above is applied to the resultant interlaced yarn, the restriction relationship between the both filaments becomes greater, and thus the uniformity of the false twisted yarn is further improved. The number of the interlaced portions of the yarn is preferably 40 to 100/m.

Figure 3:
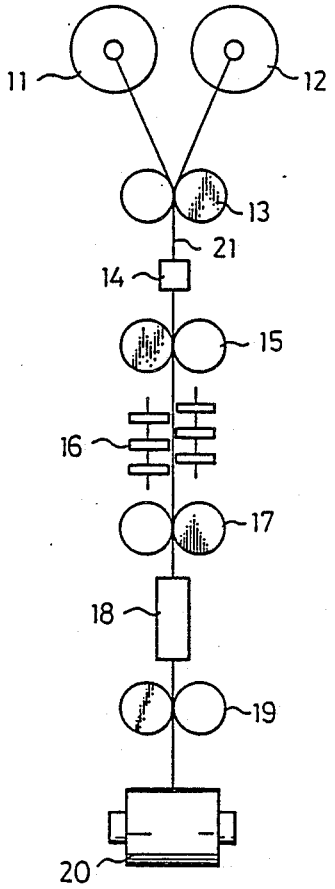
FIG. 3 is an explanatory view of an embodiment of the apparatus used in the process of the present invention.

FIG. 3 shows an example of the apparatus used in the process of the present invention, in which, for example, a polyester undrawn filament 11 and an additional filament 12 consisting of a moderately oriented polyester filament with a lower drawability (higher orientation) than that of the undrawn filament 11, are arranged in parallel (doubled), and the resultant parallel yarn 21 is fed through a pair of feed rollers 13 to a processing apparatus. The parallel yarn 21 is interlaced by an air nozzle 14, and then delivered via intermediate rollers 15 to a false twisting apparatus 16 where it is twisted. As a result, the undrawn filament 11 is drawn by being wound around additional filament 12 in the front half portion of the false twisting apparatus 16, and released from the twist in the rear half portion of the false twisting apparatus 16, to thus release the winding. In the thus obtained composite yarn, both filaments 11 and 12 pass through delivery rollers 17 while interlaced, are heat set in a heater 18, and then wound up via take-up rollers 19 on a winder 20. When the processed yarn is woven and dye-finished, because the filaments are drawn while the polymer molecules in the filaments are frozen, the resultant woven fabric exhibits a very different touch from the conventional synthetic fiber woven fabrics; namely is ultra-soft and has a special touch like a marshmallow, and is entirely free from unevennesses in the thickness and in the dyed colors, etc.

In the present invention, to obtain this touch, when the undrawn filament 11 is drawn in the false twisting procedure, the polymer molecules in the filament must be frozen. Accordingly, the twisting operation must be carried out at a temperature of the glass transition point (second order transition point temperature) of the filament 11 or lower. Therefore, the filament 11 must not be heated at the thermoplastifying temperature used in the conventional false twisting procedure, i.e., at a high temperature of 160° C. to 240° C., and the twist-applying heat-set-twist release operations must be carried out at a temperature of 120° C. or lower, preferably 100° C. or lower (for a heat treatment time of 0.6 second or less). Generally speaking, as in the above example, the best result can be obtained by performing the false twisting procedure at room temperature without heating. Particularly, when a filament having a low glass transition temperature is used, it is compulsorily cooled if necessary.

Also, although it is not essential that the undrawn filament 11 and the additional filament 12 be first interlaced, the interlacing provides an effect such that the undrawn filament 11 is more uniformly drawn, and another effect such that, after the twisting is applied and released, the resultant processed yarn cannot loosen and open into individual filaments. This prevention of opening may be also obtained by application of the interlacing treatment after releasing the false twisting, but generally, when the interlacing procedure is applied before the false twisting procedure, a greater opening prevention effect is obtained.

When the undrawn filament 11 is drawn in a small amount, preferably the additional filament 12 is drawn as described above, to thereby increase the elongation. Referring to FIG. 3, it can be seen that, preferably, the speed relationship between the roller 15 and the roller 17 is set to a condition at which the additional filament 12 can be drawn, to thereby conduct the draw-false twisting procedure, as this allows the undrawn filament 11 to be uniformly drawn without the occurrence of the irregularities fibers described above. Particularly, when the false twisting is performed by using a frictional false twisting apparatus, slippage of the filament yarn on the friction surface occurs, and therefore, preferably the false twisting is conducted while drawing the yarn. On the other hand, when a spindle false twisting apparatus is used, the draw-false twisting procedure is not necessary. But, generally speaking, the frictional false twisting procedure allows a smooth running of the filament.

When the filament is twisted in the false twisting step, to cause only the undrawn filaments 11 to be drawn in a tendril form, the additional filament 12 must exhibit a lower drawing property than the undrawn filament 11, and accordingly, preferably a moderately oriented filament, or a highly oriented filament having a birefringence of 0.03 or higher, is used as the additional filament 12. Also, preferably the additional filament 12 has a drawing property smaller by 70% or more in terms of the natural elongation ratio (represented by elongation %) than the undrawn filament 11.

In the process of the present invention the frozen polymer molecules are forcibly stretched, thereby generating a specific ultra-soft touch of the processed yarn, and the drawing of the undrawn filament 11 becomes more difficult with a disarrangement of the polymer polecules within the undrawn filament 11 in the longitudinal direction thereof before the drawing procedure, namely with a lowering of the degree of orientation thereof, whereby the specificity of the touch of the processed yarn is increased. Accordingly, preferably 0.02 or less, as represented by the birefringence, more preferably 0.01 or less, at which the filament is substantially nonoriented.

As described above, the filament forcibly drawn at a low temperature in accordance with the process of the present invention generally has a great inner stress, and thus a high shrinkage rate in boiling water, and therefore, the shrinkage rate thereof must be lowered before use by a heat treatment. In the apparatus shown in FIG. 3, the heater 18 is used for this purpose at a heating temperature of preferably 130° C. or more, more preferably 160° C. or more, and preferably the heating procedure is conducted at this temperature for at least 0.1 sec. If the heating after the false twisting procedure is continuously applied subsequent to the above drawing step, the resultant processed yarn can be used in any desired field, but depending on the use, after the processed yarn is formed in, for example, a woven or knitted fabric, the above-mentioned shrinkage rate lowering treatment may be also applied thereto.

In the present invention, the mixing ratio of the undrawn filament 11 to the additional filament 12 is preferably as described below. Namely, since the unique touch of the processed yarn in accordance with the present invention is derived from the filament drawn under the condition that the polymer molecules are frozen (namely, the undrawn filament 11), then from the low orientation filament (=filament with a large natural draw ratio), preferably the ratio in weight of the undrawn filament to the entire processed yarn is ¼ or more. But, particularly when a filament having a degree of molecular orientation which makes the drawing of the filament difficult is used, the drawing property may be sometimes preferentially given even if the touch of the resultant processed yarn is lowered to some extent, although in this case, the content of the undrawn filament 11 must be at least 30%.

On the other hand, if the proportion of the low orientation filament becomes too high, the thickness of the high orientation filament [additional filament 12] becomes excessively small, it becomes difficult to wind the undrawn filament 11 in tendril form, and the filament is broken, and therefore, preferably the amount of the low orientation filament 11 is at most 80% or less.

In the process of the present invention, the formation of false twists and crimps is not intended, and therefore, even when the number of twists imparted in the false twisting step is not equal to that obtained in the conventional false twisting procedure, the effect of the present invention still can be obtained. For example, in the conventional false twisting procedure, effective crimps cannot be obtained at a low twist number of about 14000/ $\sqrt{De}$ t/m, but in the present invention, the cold drawing procedure of the filament is effected in accordance with the twist number, whereby the effect corresponding to such a drawing is obtained. Nevertheless, except for filaments for which twisting is particularly difficult, preferably the false twisting procedure is conducted at as large a false twist number as possible, namely a false twist number not more than the false twist number 32000/ $\sqrt{De}$ t/m at which breakage of the filament readily occurs, but as long as a stable processing is possible, the low orientation filament can be drawn to an extent at which the greatest effect is obtained. When false twisting is performed by the frictional false twisting method, it is difficult to measure the false twist number, but the ratio D/Y is preferably controlled to a value of about 1.3 to 2.8.

Here,

De=total deniers of the filament yarn false twist-drawn; and

D/Y=surface speed of false twisting disk/speed of filament during false twisting procedure.

The ultra-soft, flat multifilament yarn of the present invention prepared in accordance with the process of the present invention as described above comprises two or more types of multifilaments having different elongations, and the multifilament (Fe) with the highest elongation in the yarn has an elongation of 60% or more, preferably 80 to 150%, and preferably has the following features (A) to (D):

(A) the crystallinity (x) measured by the density method is 10% to 30%, preferably 15% to 25%;

(B) the orientation ($\Delta na$) at the non-crystalline or amorphous portion is 0.035 to 0.10, preferably 0.045 to 0.10;

(C) the density at the non-crystalline portion ($\rho a$) is 1.31 to 1.36 g/cm$^3$, preferably 1.33 to 1.35 g/cm$^3$;

(D) the Young's modulus (YM) is 200 to 700 kg/mm$^2$, preferably 250 to 450 kg/mm$^2$ The significance of the above features (A) to (D) is described below.

Feature (A)

The drawn yarn of the prior art comprises crystals having a large size and densely filled therein, but in the flat multifilament yarn of the present invention, although many non-crystalline portions remain therein, the crystals are dispersed within the non-crystalline chains, and thus the crystallinity is appropriately 15 to 30%.

Feature (B)

As a specific feature of the flat multifilament yarn of the present invention, the feature (B) is important. Namely, the orientation of the non-crystalline portion of 0.035 to 0.10 is higher than the non-crystalline portion orientation of the conventional heat treated POY, and within a range lower than that of the conventional drawn yarn. That is, although the crystallinity of the flat multifilament yarn of the present invention (feature (A)) overlaps that of the conventional heat treated POY yarn, the non-crystalline portion orientation (feature (B)) thereof is different from that of the conventional drawn yarn, and due to this characteristic, the performance of the flat multifilament yarn of the present invention can be improved. In this regard, in a non-heat treated filament (e.g., POY), it is impossible to calculate the non-crystalline portion orientation because the crystal orientation (fc) cannot be measured. Nevertheless, in the high elongation multifilament in the flat multifilament yarn, it can be determined that the fc is from 80 to 90%, and therefore, the non-crystalline portion orientation thereof can be determined.

Feature (C)

In Feature (C), the non-crystalline density ($\rho a$), which is 1.31 to 1.36 g/cm$^3$, means that the content of non-crystalline chains in the high elongation multifilament is high. If the density ($\rho a$) is less than 1.31 g/cm$^3$, the effects of the multifilament yarn are unsatisfactory, and if the density ($\rho a$) exceeds 1.36, the touch of the flat multifilament yarn is undesirably hard.

Feature (D)

The high elongation multifilament (Fe) satisfying the above features (A), (B) and (C) has a relatively lower Young's modulus of 200 to 700 kg/mm$^2$, and consequently, a processed yarn having a desired soft touch can be obtained even when using a high elongation multifilament (Fe) having a denier of 1 or more, particularly 2 or more. Accordingly, it is not necessary to use a very thin multifilament having a denier of 0.9 or less, as used in the prior art, to obtain a soft flat multifilament yarn.

The high elongation multifilament (Fe) satisfying the above features (A) to (D), after a boiling water relax treatment, exhibits a self-elongating property at a temperature higher than the boiling water relax treatment temperature of, for example, 120° C. or higher.

The high elongation multifilament (Fe) preferably consists essentially of a polyester, for example, polyethylene terephthalate, but is not limited thereto.

The ultra-soft and flat multifilament yarn of the present invention, which was obtained via the false twisting procedure but without applying a heat setting operation during the false twisting procedure, does not have false twisted crimps and is free from deformation of the cross-sectional profile of the filaments. Accordingly, the ultra-soft, flat multifilament yarn of the present invention has substantially no torque, and the constituent multifilaments therein are in the non-crimped (flat) form.

In the false twisting procedure in the process of the present invention, since the heating temperature for the multifilament yarn to be false twisted is 120° C. or less (preferably 100° C. or less, particularly not higher than the glass transition temperature of the multifilaments) the cross-sectional profiles of the multifilaments are not deformed, and no crimp appears when the twists are released.

More specifically, in the production steps as shown in FIG. 3, the ultra-soft flat multifilament yarn of the present invention is formed from the multifilament 11 with a high stretchability and the multifilament 12 with a low stretchability, and the resultant multifilament yarn contains two or more types of multifilaments having different heat shrinkabilities. Accordingly, the multifilament yarn of the present invention has a potential hetero-shrinkability.

To improve this potential hetero-shrinkability, the multifilament yarn of the present invention preferably contains the high elongation multifilament (Fe) having an elongation of 60% or higher and the low elongation multifilament (Fc) having an elongation of 50% or higher. The low elongation multifilament (Fc) shrinks at a temperature of 180° C. or lower.

The low elongation multifilament (Fc) preferably consists essentially of a polyester, for example, polyethylene terephthalate, but is not limited thereto.

The multifilament yarn of the present invention preferably is composed of the high elongation filaments (Fe) and the low elongation filaments (Fc), which are mutually fabricated as a mixture and interlaced to form an integral yarn. The extent of such interlacing is preferably such that the interlaced filament number is from 30 to 80 filament/m. The mixing weight ratio of the high elongation multifilaments (Fe) and the low elongation multifilaments (Fc) is preferably Fe:Fx=3:7 to 8:2, the thickness of the individual high elongation multifilaments (Fe) is preferably 1 to 8 denier, and the thickness of the individual low elongation multifilaments (Fc) is 1.5 to 6 denier. The ratio in denier of the individual high elongation multifilaments (Fe) to the individual low elongation multifilaments (Fc) is preferably 0.7:1 to 1.5:1.

The high elongation multifilaments (Fe) may have a circular cross-sectional profile or an irregular cross-sectional profile such as triangular shape.

To ensure that the potential hetero-shrinkability of the multifilament yarns is fully exhibited in the relax step, to thereby improve the bulk characteristic, the multifilament yarn as a whole preferably has a boiling water shrinkage (BWS) of 1.5 to 15%, the high elongation multifilaments (Fe) thereof exhibit a boiling water shrinkage rate of 2 to 6%, and the low elongation multifilaments (Fc) exhibit a boiling water shrinkage rate of 2 to 10%.

The multifilament yarn of the present invention, can be used to obtain an ultra-soft flat multifilament yarn fabric by weaving or knitting the multifilament yarn of the present invention, and subjecting the gray fabric to the conventional scouring, dyeing and finishing steps, if necessary. The ultra-soft fabric of the present invention preferably is composed of high elongation multifilaments (Fe') having the following characteristics (a) to (d):

(a) the crystallinity ($x_c$) determined in accordance with the X-ray method is 45% or less, preferably 40% or less;

(b) the crystal orientation (fc) is 85% or less, preferably 80% or less;

(c) the non-crystalline portion density ($\rho a$) is 1.335 g/cm$^3$ or more, preferably 1.345 g/cm$^3$, and the difference in the density of the whole filament ($\rho$) is 0.05 g/cm$^3$ or less;

(d) the non-crystalline portion orientation ($\Delta na$) is 0.05 or more, preferably 0.06 or more, and another low elongation multifilament (Fc').

The high shrinkage multifilaments (Fe') preferably have a crystal size of 45 angstrom or less at the [010] plane, and a crystal size of 45 angstrom or less at the plane [100].

The thickness of the individual high shrinkage multifilament [Fe'] is preferably 1 to 3 denier.

The high elongation multifilaments (Fe') were found to exhibit a specific self-elongation behaviour under a dry heat treatment at 120° C. or more. But the other low elongation multifilaments (Fc') are further shrunk by the dry heat treatment at 120° C. or more, and thus, by utilizing the different heat shrinkage/elongation behaviors of the multifilaments (Fe') and (Fc'), the ultra-soft fabric of the present invention can be converted to an ultra-soft and bulky fabric. For this purpose, a fabric (gray fabric) is formed from the multifilament yarns of the present invention comprising the high elongation multifilaments (Fe') and the low elongation multifilaments (Fc'), which are subjected to the boiling water relax treatment to provide both the shrunk filaments (Fe') and (Fc'), and then subjected to the dry heat treatment at a temperature of 120° C. or more to allow a self-elongation of the high elongation multifilaments (Fe') and a shrinking of the low elongation multifilament (Fc'), whereby the difference in the filament length of the multifilaments is of the high elongation multifilaments (Fe') and the low elongation multifilaments (Fc') is controlled to 3 to 10%, more preferably 5 to 10%, on the basis of the length of the low elongation multifilaments (Fc'). In contrast, the filament length difference of different types of multifilaments in the conventional hetero-shrinkable composite multifilament is at most 3%.

The steps of the process of the present invention may be appear similar to the steps in the production process of the false twisted double wound layer structure processed yarn disclosed in Japanese Unexamined Patent Publication (Kokai) Nos. 61-19733 and 56-25529, but the effects and the structures of the processed yarns produced thereby are entirely different from those of the present invention.

Figure 4A:
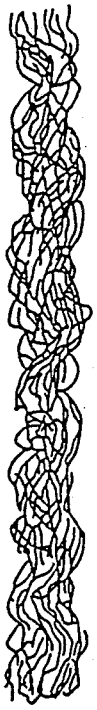
Fig. 4(a) (PRIOR ART)
FIG. 4 (*a*) is a side view illustrating the false twisted multifilament yarn of the prior art.
Figure 4B:
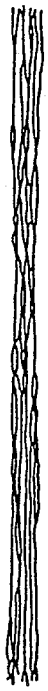

More specifically, in the case of the conventional false twisted double wound layer structure processed yarn, one type of multifilament is wound around an other type of multifilament in the false twisting step, the resultant composite yarn is heated at a high temperature, and the polymer molecules in the multifilaments in the twisted form are subjected to reorientation crystallization, whereby both types of multifilaments are thermally fixed in a false twisted and wound form. Therefore, even if the composite yarn is subjected to twist release, the wound form or the twisted form of the wound filaments remains, and therefore, a "wound" double layer structure processed yarn as shown in FIG. 4 (*a*) is obtained. Such a conventional false twisted double wound layer structure processed yarn has a specific feature in having a spun fiber touch. In contrast, in the process of the present invention, even if the highly stretchable multifilament is wound around the low elongation multifilament in the false twisting procedure, since no heat setting occurs in this state, no residual winding or twisting kinks remain, each filament in the resultant processed yarn is straight as shown in FIG. 4 (*b*) (having no crimp), and a spun yarn-like structure is not formed. Namely, the filaments in the processed yarn are straight, and therefore, form a flat multifilament yarn. In the process of the present invention, by effecting the false twisting procedure while forcibly elongating the highly stretchable multifilaments at a low temperature, the resultant processed yarn becomes a flat multifilament yarn having an extremely soft touch and unique feeling entirely different from those of the conventional false twisted, drawn processed yarn.

Also, when the filaments are forcibly drawn at the glass transition temperature of the filament or lower, for example, at room temperature, since the polymer molecules are frozen, a very strong drawing force becomes necessary. Particularly, in the filament wherein polymer molecules are not substantially oriented, such as the undrawn filament produced at a spinning speed of 2000 m/min or less, the force required for drawing is much stronger. Therefore, in a low temperature drawing procedure in accordance with such a conventional process, drawn lapping, breakage, and fluffing of the filament occur, or slippage is generated, whereby the process cannot be carried out smoothly. Nevertheless, when the filament is drawn with the twisting force as in the process of the present invention, this drawing can be effected smoothly. The drawing force is primarily imparted by the twisting force (twist applying force), and therefore, an installation for winding the yarn many times around rollers, as when using a drawing machine, is not necessary. Therefore, the process of the present invention is characterized in that the drawing procedure can be carried out simply by using a one nip roller means, as in a conventional false twisting machine, without production problems.

Further, the flat multifilament yarn of the present invention is extremely flexible and has a unique feeling unobtainable in the synthetic fiber yarn of the prior art. Particularly, when the present invention is applied to polyester fibers having a relatively higher modulus, and therefore a hard feeling and strong firmness, the hardness characteristic of the former polyester fiber disappears and a filament yarn with a very soft and unique touch, that is an extremely soft and warm touch, can be obtained. The multifilament yarn of the present invention can be widely applied for uses such as lingerie or baby clothes, which are brought into direct contact with skin, and has a great merit.

The base material of the filament to be used in the present invention is not particularly limited, provided that it is a stretchable synthetic fiber, but particularly when a polyester fiber is employed, the essentially hard feeling thereof can be remarkably obviated to provide an extremely soft and unique touch. Also, since the polyester has a relatively high glass transition temperature, the effect of low temperature freeze-drawing in the process of the present invention can be further remarkably exhibited, and therefore, the effect of the present invention can be clearly shown.

EXAMPLES

The present invention is further described with reference to the following Examples.

In the Examples, the following measurements were conducted.

Crystallinity ($x_c$) by X-ray method

The X-ray diffraction intensity curve of the sample provided was measured by a combination of X-ray generation device (RAD-IIIA) manufactured by Rigaku Denki K.K. and a counter PSPC system. The measurements were carried out by using a 35 kv x 10 mA, CuK$\alpha$-line Ni filter, and a divergent slit of 1 mm$\phi$.

The sample was rotated within the plane vertical to the X-ray beam for a measurement of the whole scattering intensity curve (in the case of a polyester filament, measured at $2\theta = 10°$ to 40°), and similarly, the scattering intensity curve of the non-crystalline sample was measured and the crystallinity xc was calculated from the following formula.

$$x_c\,(\%) = \frac{\text{Area of crystalline portion} \times 1.136}{\text{Total area} - \text{area of air scattering}} \times 100$$

Crystal orientation (fc) by X-ray method

Obtained from the half-value width Ho in the intensity curve in the (110) directory angle direction, calculated according to the following equation.

$$fc\,(\%) = \frac{180° - H°}{180°} \times 100$$

(Note) In the diffraction at (100) face, spots are not always concentrated on the equatorial line, but are separated and appear above and below the equatorial line, and therefore, a diffraction at the (110) plane was employed.

Birefringence (Δn)

The measurement was conducted in accordance with the Senarmo method, using a polarizing microscope.

Density (ρ)

The measurement was conducted in n-heptane/carbon tetrachloride at 25° C., using a density gradient tube.

Crystallinity (xρ) by the density method xρ was calculated according to the following equation:

$$x\rho(\%)=(0.7491-1/\rho)/0.06178.$$

Non-crystalline portion orientation Δna

Δna was calculated in accordance with the following equation:

$$\Delta na=(\Delta n-0.212\ fc.x\rho)/(1-x\rho)$$

Non-crystalline portion density ρa

ρa was calculated according to the following equation:

$$\rho a=(1-xc)/(1/\rho-xc/\rho c)$$

Here, ρc equaled 1.455 g/cm$^3$.

Crystal size by X-ray method

The crystal sizes were determined by using (100), (010) plane reflections in accordance with the Sherrer equation shown below.

$$L_{hkl}=K\lambda/\beta\cos\theta_{hkl}.$$

Here, Lhkl is a crystal size in the vertical direction to the (hkl) plane; β is the half-value width of reflection profile and determined from $\beta=\beta_M-\beta_E$ with the found value being $\beta_M$ and the device constant $\beta_E$; K is a constant of 0.94; θ is the Bragg angle; and λ is the X-ray wavelength of 1.5418 Å.

Boiling water shrinkage (BWS) and dry heating shrinkage (HS) of multifilament yarn A hank of about 3000 denier was prepared, and the original length $l_0$ (cm) was determined under a load of 0.1 g/de. The load for the above hank was changed to 2 mg/de, the hank was heat treated in boiling water for 30 minutes, dried at room temperature, and then the load was changed to 0.1 g/de and the length $l_1$ (cm) was determined. Then the load was again changed to 2 mg/de, and the hank after heat treatment in heated air at 180° C. was taken out, and the load was changed to 0.1 g/de and the length $l_2$ (cm) was determined.

$$\text{Boiling water shrinkage } BWS\ (\%) = \frac{l_0 - l_1}{l_0} \times 100$$

$$\text{Dry heating shrinkage } HS \text{ at 180° C. (\%) boiling with water} = \frac{l_2 - l_0}{l_0} \times 100$$

$$\text{Self-elongatiion} = BWS\ (\%) - HS\ (\%).$$

The flexibility of the fabric was evaluated by determining the bending stiffness (BS) and the resilience of fabric at that bending resilience (BR). The 6.20.3.C method (the stiffness and softness loop compression method) of JIS L 1096 was used as the measurement method.

The antipilling property was measured and evaluated by using the ICI form tester shown in 4.1 of JIS L 1076 according to the A method (the method using an ICI form tester) shown in 6.1 of the same test method.

The abrasion strength was measured in accordance with the A-3 method (folding method) of JIS L 1096, using a #600 polishing paper.

EXAMPLE 1

A polyester low orientation undrawn yarn with a circular cross-section, a birefringence of 0.009, a natural draw ratio of 152% (corresponding to a draw ratio of 2.52), an ultimate elongation of 342%, a glass transition point of 80° C., a thickness of 90 de, and a filament number of 24, and a polyester high orientation undrawn yarn with a circular cross-section, a birefringence of 0.043, a natural draw ratio of 45% (corresponding to a draw ratio of 1.45), an ultimate elongation of 140%, a glass transition point of 80° C., a thickness of 78 de, and a filament number of 36 were arranged in parallel at a formulation ratio of 54:46, and the parallel yarn was subjected to a filament interlacing procedure by using an air interlacing nozzle at an overfeed ratio of 1.0% and a compressed air pressure of 4 kg/cm$^2$, to provide interlaced filaments. Next, the yarn was fed into a triaxial type frictional false twisting apparatus under a rotation having a peripheral speed of 630 m/min., and false twisted and drawn at a speed of 350 m/min. at an elongation of 55%, a false twisting tension of 32 g, and a twist releasing tension of 27 g, at room temperature (25° C.) and a D/Y of 1.8. After the twisting applied to the interlaced multifilament yarn was released, the resultant processed yarn was heated at an overfeed ratio of 0% in a heater at 230° C. (heat treatment time: 0.2 sec.) to lower the heat shrinkage rate of each filament, and the resultant processed yarn was wound up on a winder. The resultant processed yarn had a denier of 106 and 60 filaments. When the yarn was observed under a microscope, no deformation was found in the cross-sectional profile of each filament. Further, the yarn itself had no torque, had substantially no crimps formed in the filaments, and exhibited substantially the same appearance as a conventional mixed flat multifilament yarn.

When, in the above processing, only a drawing operation was applied without using the false-twisting apparatus, the drawing force was 120 g/d.

The characteristics of the resultant flat multifilament yarn were as shown in Table 1.

TABLE 1

| Items | | Unit | Measured value |
|---|---|---|---|
| Total thickness | (De) | denier | 106 |
| Number of filament | (F) | filament | 60 |
| Tensile strength | (St) | g/de | 2.2 |
| Ultimate elongation | (El) | % | 21.0 |
| Young's modulus | (YM) | kg/mm$^2$ | 670 |
| Crimp percentage | (TC) | % | 0.8 |
| Shrinkage rate in boiling water | BWS | % | 3.2 |
| Dry 180° C. heat shrinkage after boiling water treatment | HS | % | 5.6 |
| Number of interlaced portions per meter | IL | | 78 |
| Deformation of cross-sectional profile | | | none |

The filament structures and the characteristics of the high elongation multifilament component (Fe) derived from the low orientation undrawn filaments and the low elongation multifilament component (Fc) derived from the high orientation undrawn filaments in the resultant flat multifilament yarn were as shown in Table 2.

TABLE 2

| Filament Structure | | | | |
|---|---|---|---|---|
| | | | Measured value | |
| Items | | Unit | Component (Fe) | Component (Fc) |
| Thickness | De | denier | 58.0 | 50.3 |
| Number of filaments | F | filament | 24 | 36 |
| X-ray method crystallinity | xc | % | 13 | 39 |
| X-ray method orientation | fc | % | 86 | 90 |
| X-ray method crystal size | (010) | Å | 21 | 23 |
| X-ray method crystal size | (100) | Å | 32 | 23 |
| Density | ρ | g/cm$^3$ | 1.3568 | 1.3654 |
| Birefringence | Δn | | 0.098 | 0.113 |
| Density method crystallinity | xρ | % | 19.5 | — |
| Non-crystalline portion orientation | Δna | | 0.078 | — |
| Young's modulus | YM | kg/mm$^2$ | 337.3 | 1060 |
| Tensile strength | St | g/de | 0.85 | 5.0 |
| Ultimate elongation | El | % | 113.4 | 25.6 |
| Crimp Percentage | TC | % | 0.5 | 0.3 |
| Shrinkage rate in boiling water | BWS | % | 3.0 | 3.8 |
| Dry 180° C. heat shrinkage after boiling water treatment | HS | % | −1.4 | 7.0 |
| Self-elongation | BWS-HS | % | 4.4 | — |
| Non-crystalline portion density | ρa | cm$^3$/g | 1.343 | |

A dyed fabric was prepared from the processed yarn under the weaving conditions (structure: twill), alkali treatment, and dyeing conditions shown in Table 3.

TABLE 3

| Weaving and Dyeing Conditions | | |
|---|---|---|
| Step | Item | Condition |
| Weaving | Twisting | 800 T/m (Z direction) |
| | Green fabric density | warp 39.5/cm weft 32.3/cm |
| Dyeing | Relax | 85° C. × 20 min. |
| | Preset | 180° C. × 45 min. |
| | Alkali weight reduction | 0% and 8% |
| | Dyeing | 120° C. × 45 sec. |
| | Finishing set | 160° C. × 45 sec. |

The characteristics of the resultant fabric were as shown in Table 4.

TABLE 4

| Fabric Characteristics | | | | | |
|---|---|---|---|---|---|
| | | Fabric without alkali weight reduction | | Fabric with 8% alkali weight reduction | |
| | | warp direction | weft direction | warp direction | weft direction |
| Density | number/cm | 28.3 | 23.7 | 28.0 | 23.7 |
| Weight | g/m$^2$ | 102.6 | | 89.4 | |
| Thickness | mm | 0.265 | | 0.232 | |
| Bulkiness | cm$^3$/g | 2.58 | | 2.60 | |
| Bending | g | 0.67 | 0.63 | 0.45 | 0.43 |

TABLE 4-continued

| Fabric Characteristics | | | | | |
|---|---|---|---|---|---|
| | | Fabric without alkali weight reduction | | Fabric with 8% alkali weight reduction | |
| | | warp direction | weft direction | warp direction | weft direction |
| stiffness* | | | | | |
| Bending resilience BR | % | 86.0 | 84.0 | 87.0 | 85.0 |
| Antipilling property | class | 4–5 | | 4–5 | |
| Abrasion strength | times | 92 | | 68 | |
| Tear | g | 1550 | 1440 | 1450 | 1380 |

Note: *The bending stiffness of the fabric prepared from conventional mixed filament drawn yarns having different boiling water shrinkage rates was around 1.5 g before alkali weight reduction and around 1.2 g after alkali weight reduction.

When an alkali weight reduction was not applied, the filament structures and the characteristics of the high elongation multifilament component (Fe') derived from the low orientation undrawn filaments and the low the high orientation undrawn filaments constituting the fabric were as shown in Table 5.

TABLE 5

| Yarn structure and characteristics of fabric | | | | |
|---|---|---|---|---|
| | | | Component (Fe') | Component (Fc') |
| Crystallinity by X-ray method | xc | % | 36 | 51 |
| Orientation by X-ray method | fc | % | 77 | 91 |
| Crystal size by X-ray method | (010) | Å | 36 | 44 |
| Crystal size by X-ray method | (100) | Å | 37 | 53 |
| Density | ρ | g/cm$^3$ | 1.3881 | 1.3938 |
| Birefringence | Δn | — | 0.116 | 0.144 |
| Crystallinity by density method | xρ | % | 46.4 | — |
| Orientation of non-crystalline portions | Δna | — | 0.075 | — |
| Non-crystalline portion density | ρa | g/cm$^3$ | 1.353 | — |
| Young's modulus | YM | kg/mm$^2$ | 121 | 578 |
| ρ−ρa | | — | 0.0351 | — |

EXAMPLE 2

A polyester low orientation undrawn yarn having a birefringence of 0.008, a natural draw ratio of 174% (corresponding to a draw ratio of 2.74, an ultimate elongation of 408%, a glass transition point of 80° C., a thick of 150 de, and a filament number of 20, and a polyester high orientation undrawn yarn having a birefringence of 0.048, a natural draw ratio of 45% (corresponding to a draw ratio of 1.45), an ultimate elongation of 128%, a glass transition point of 80° C., a thickness of 115 de, and a filament number of 15, were arranged in parallel at a formulation ratio of 67:43. The parallel yarn was subjected to an air interlacing procedure using an air interlacing nozzle at an overfeed ratio of 1.0% and a compressed air pressure of 4.0 kg/cm$^2$, to interlace the filaments. Next, the interlaced yarns were passed through the tri-axial type frictional false twisting apparatus under a peripheral rotation speed of 800 m/min, at a speed of 400 m/min. and at an elongation of 50% (false twisting tension: 47 g, twist release tension: 44 g) to apply a false twist-drawing procedure (D/Y=2.0) at room temperature (30° C.). After the false twisting operation was once applied, the twists were released and then heating was conducted by a heater at 245° C. and an overfeed ratio of 0.2% (heat treatment time: 0.2 sec.) to decrease the heat shrinkage rate of each filament, and the resultant processed yarn wound up on a winder. The resultant processed yarn was 176 denier/35 filaments. When the yarn was observed by a microscope, no deformation was seen in the cross-sectional profile of each filament. Further, the yarn itself had no torque, and no crimps occurred in the filaments. The yarn had substantially the same appearance as a conventional mixed flat filament yarn.

When, in the above-mentioned process, only drawing was performed without using the false twisting apparatus, the drawing force was 155 g/d.

The characteristics of the resultant processed yarn were as shown in Table 6.

TABLE 6

| Items | | Unit | Measured value |
|---|---|---|---|
| Thickness | De | denier | 176 |
| Number of filament | F | filament | 35 |
| Tensile strength | St | g/de | 1.92 |
| Ultimate elongation | El | % | 26.2 |
| Young's modulus | YM | kg/mm$^2$ | 560 |
| Crimps percentage | TC | % | 0.4 |
| Shrinkage rate in boiling water | BWS | % | 3.5 |
| Dry 180° C. heat shrinkage after boiling water treatment | HS | % | 6.5 |
| Number of interlaced portions per meter | IL | | 68 |
| Deformation of cross-sectional profile | | | none |

The filament structures and the characteristics of the high elongation multifilament component (Fe) derived from the low orientation undrawn filaments and the low elongation multifilament component (Fc) derived from the high orientation undrawn filaments in the resultant flat multifilament yarn were as shown in Table 7.

TABLE 7

| Items | | Unit | Measured value Component (Fe) | Component (Fe) |
|---|---|---|---|---|
| Thickness | De | denier | 97 | — |
| Number of filaments | F | filament | 20 | — |
| Crystallinity by X-ray method | xc | % | 16 | — |
| Orientation by X-ray method | fc | % | 85 | — |
| Crystal size by X-ray method | (010) | Å | 52 | — |
| Crystal size by X-ray method | (100) | Å | 51 | — |
| Density | ρ | g/cm$^3$ | 1.3513 | — |
| Birefringence | Δn | | 0.065 | — |
| Crystallinity by density method | xρ | % | 14.7 | — |
| Orientation of noncrystalline portions | Δna | | 0.045 | — |
| Young's modulus | YM | kg/mm$^2$ | 337 | — |
| Tensile strength | St | g/de | 0.95 | — |
| Ultimate elongation | El | % | 115.0 | 28.3 |
| Crimp percentage | TC | % | 0.2 | — |
| Shrinkage rate in boiling water | BWS | % | 3.2 | 3.7 |
| Dry 180° C. heat shrinkage after boiling water treatment | HS | % | −1.0 | 6.5 |
| Self-elongation | BWS-HS | % | 4.2 | — |
| Density of non-crystalline portions | ρa | g/cm$^3$ | 1.333 | — |

A dyed fabric was prepared from the processed yarn under the weaving (structure: twill), alkali weight reduction treatment, and dyeing conditions shown in Table 8.

TABLE 8

Weaving and Dyeing Conditions
Structure: twill

| Step | Item | Condition |
|---|---|---|
| Weaving | Twisting | 750 T/m (S direction) |
| | Density of green fabric | warp 29.6 yarns/cm<br>weft 24.8 yarns/cm |
| Dyeing | Relax | 85° C. × 20 min. |
| | Pre-set | 180° C. × 45 min. |
| | Alkali weight reduction (%) | 0% |
| | Dyeing | 120° C. × 45 sec. |
| | Finish-set | 160° C. × 45 sec. |

The characteristics of the resultant fabric were as shown in Table 9.

TABLE 9

Characteristics of fabric

| | | No alkali weight reduction-applied Warp direction | Weft direction |
|---|---|---|---|
| Density | yarns/cm | 29.4 | 24.6 |
| Weight | g/m$^2$ | 123 | |
| Thickness | mm | 0.286 | |
| Bulkiness | cm$^3$/g | 2.33 | |
| Bending stiffness* | g | 1.9 | 1.7 |
| Bending resilience BR | % | 96.2 | 95.3 |
| Antipilling property | class | 5 | |
| Abrasion resistance | times | 146 | |

Note: *The BS was about 4.5 g when a conventional drawn yarn (individual filament (denier: 5.0) was used.

Accordingly, in the flat yarn of the present invention, when the individual filament is thick, a soft fabric having a good fabric resilience was obtained, and therefore, the alkali weight reduction was not necessary. Further, as an additional specific feature of the yarn, the antipilling characteristic and abrasion resistance of the yarn were found to be remarkably improved, as apparent from Table 4 and Table 9.

The characteristics of the high elongation multifilament component (Fe') derived from the low orientation undrawn filaments constituting the fabric were as shown in Table 10.

TABLE 10

Filament Structure and Characteristics of Fabric

| | | | Component (Fe') |
|---|---|---|---|
| Crystallinity by X-ray method | xc | % | 34 |
| Orientation by X-ray method | fc | % | 78 |
| Crystal size by X-ray method | (010) | Å | 58 |
| Crystal size by X-ray method | (100) | Å | 57 |
| Density | ρ | g/cm$^3$ | 1.3850 |
| Birefringence | Δn | | 0.110 |
| Crystallinity by density method | xρ | % | 43.8 |

TABLE 10-continued

| Filament Structure and Characteristics of Fabric | | | Component (Fe') |
|---|---|---|---|
| Orientation of non-crystalline portions | Δna | | 0.067 |
| Density of non-crystalline portions | ρa | g/cm$^3$ | 1.352 |
| Young's modulus | YM | kg/mm$^2$ | 269 |

INDUSTRIAL APPLICABILITY

The process of the present invention can produce an ultra-soft flat multifilament yarn having a very soft and unique touch by utilizing a false twisting apparatus with an easy operation and an extremely high efficiency. The ultra-soft flat multifilament yarn and fabric of the present invention have unique touch and excellent physical characteristics, and can be widely utilized for clothing such as lingerie, baby clothes, and other high resiliency soft clothing (e.g., suiting).

What is claimed is:

1. A process for preparing an ultra-soft, flat, multifilament, polyester yarn which comprises:

(a) forming a united, polyester, multifilament bundle comprising at least one high elongation multifilament having a first natural draw ratio and at least one low elongation multifilament having a second natural draw ratio, wherein a difference between the first natural draw ratio and the second natural draw ratio is at least 70% in terms of elongation, by arranging the at least one high elongation multifilament and the at least one low elongation multifilament in contact with each other, in parallel to form the united polyester multifilament bundle;

(b) subjecting the united polyester multifilament bundle, at a temperature below the glass transition temperature of the at least one high elongation multifilament, to a false-twisting procedure comprising:

(2) a twist applying operation wherein the filaments of the at least one high elongation polyester multifilament are wound around a core comprising the filaments of the at least one low elongation multifilament, to provide a tendril-like form, wherein the filaments of the at least one high elongation polyester multifilament are forcibly evenly drawn by a twisting force under conditions such that polymer molecules in the at least one high elongation multifilament are frozen, and (2) a twist-releasing operation in which the drawn at least one high elongation multifilaments are released from the tendril-like form; and (c) heat treating the united polyester multifilament bundle, after the twist releasing operation, at a temperature at least above the glass transition temperature of the high elongation polyester multifilament and to at least 130° C., to shrink the drawn high elongation multifilament and to convert the united multifilament bundle into a flat, polyester, multifilament yarn.

2. The process according to claim 1, wherein the false twisting temperature is not above 100° C.

3. The process according to claim 1, wherein the parallel multifilament yarns are subjected to a pneumatic interlacing procedure prior to the false twisting procedure to form an interlaced multifilament bundle.

4. The process according to claim 3, wherein after the pneumatic interlacing procedure, the resultant interlaced multifilament bundle has a number of interlaced portions thereof of 40 to 100/m.

5. The process according to claim 1, wherein the multifilament bundle is drawn during the false twisting procedure.

6. The process according to claim 1, wherein the false twisting procedure is performed by using a frictional false twisting apparatus.

7. The process according to claim 1, wherein the heat treatment temperature is at least 160° C.

8. The process according to claim 1, wherein a multifilament having a greatest first natural draw ratio among at least two multifilaments has an orientation not higher than 0.02.

9. The process according to claim 1, wherein the multifilament having a smallest second natural draw ratio among at least two multifilaments has an orientation of at least 0.03.

10. An ultra-soft, flat, multifilament yarn, produced by the process of claim 1.

11. The multifilament yarn of claim 10, wherein the at least one multifilament, having a highest ultimate elongation, has an ultimate elongation of at least 60% and has no change in a cross-section profile during the process.

12. The multifilament yarn of claim 11, wherein the at least one high elongation multifilament has the following characteristics:

(A) crystallinity determined by the density method (xρ): 10% to 30%;

(B) orientation (Δna) of non-crystalline portion: 0.035 to 0.10;

(C) density (ρa) of non-crystalline portion: 1.31–1.36/cm$^3$;

(D) Young's modulus (YM): 200 to 700 kg/mm$^2$.

13. The multifilament of claim 12, wherein the high elongation multifilament haS a crystallinity (xρ) of 15 to 25%.

14. The multifilament yarn of claim 12, wherein Young's modulus (YM) of the at least one high elongation multifilament is 250 to 450 kg/mm$^2$.

15. The multifilament yarn of claim 12, wherein the orientation of the non-crystallinity portion of the at least one high elongation multifilament is 0.045 to 0.10.

16. The multifilament yarn of claim 12, wherein the non-crystalline portion density (ρa) of the at least one high elongation multifilament is 1.33 to 1.35 g/cm$^3$.

17. The multifilament yarn of claim 11, wherein after a boiling water relax treatment, the high elongation multifilament exhibits a self-elongating property at a higher temperature than the boiling water relax treatment temperature.

18. The multifilament yarn of claim 11, wherein individual filaments of the at least one high elongation multifilament have an individual filament thickness of 1 to 8 denier.

19. The multifilament yarn of claim 11, wherein individual filaments of the at least one high elongation multifilament have an ultimate elongation of 80 to 150%.

20. The multifilament yarn of claim 11, wherein filaments in the at least one high elongation multifilament has a non-circular cross-sectional profile.

21. The multifilament yarn of claim 11, wherein the filament of the at least one high elongation multifilament exhibits a shrinkage of 2% to 6% in boiling water.

22. The multifilament yarn of claim 10, wherein the multifilament yarn has substantially no crimp.

23. The multifilament yarn of claim 10, wherein all filaments in the multifilaments have substantially no crimp.

24. The multifilament yarn of claim 10, wherein filaments of the at least one multifilament with a lowest ultimate elongation among the at least two multifilaments have an ultimate elongation not higher than 50%.

25. The multifilament yarn of claim 24, wherein filaments of the at least one low elongation multifilament shrink at a temperature of 180° or lower.

26. The multifilament yarn of claim 24, wherein the at least one low shrinkage multifilament has a boiling water shrinkage of 2 to 10%.

27. The multifilament yarn of claim 24, wherein an individual filament thickness of the at least one low elongation multifilament is 1.5 to 6 denier.

28. The multifilament yarn of claim 10, wherein the at least two multifilaments are interlaced at an interlaced filament number of 30 to 80 filaments/m.

29. The multifilament yarn of claim 10, wherein a mixing weight ratio of the at least one high elongation multifilament to the at least one low elongation multifilament is from 3:7 to 8:2.

30. The multifilament yarn of claim 10, wherein the denier ratio of the at least one high elongation multifilament to the at least one low elongation multifilament is 0.7:1 to 1.5:1.

31. The multifilament yarn of claim 10, wherein the multifilament yarn has, as a whole, a boiling water shrinkage of 1.5 to 15%.

32. An ultra-soft, flat, multifilament yarn fabric, comprising the multifilament yarn of claim 10.

33. The fabric of claim 32, in which the yarn comprises at least one high elongation multifilament having the following characteristics:

(a) a crystallinity (xc) determined by the X-ray method not above 45%;

(b) a crystal orientation (fc) not above 85%;

(c) a density (pa) of a non-crystalline portion of at least 1.335 g/cm$^3$, and a difference in the density of all filaments in the multifilament not greater than 0.05 g/cm$^3$ or less; and (d) a non-crystalline orientation degree ($\Delta$na) of at least 0.05 and at least one low elongation multifilament.

34. The fabric of claim 33, wherein the crystallinity (xc) of the high elongation multifilament is not higher than 40%.

35. The fabric of claim 33, wherein the orientation of non-crystalline portion of the at least one high elongation multifilament is not higher than 80%.

36. The fabric of claim 33, wherein the non-crystalline portion density ($\rho$a) of the at least one high elongation multifilament is 1.345 g/cm$^3$.

37. The fabric of claim 33, wherein the orientation of non-crystallinate portion ($\Delta$na) of the at least one high elongation multifilament is at least 0.06.

38. The fabric of claim 33, wherein the crystal size in (010) planes of the at least one high elongation multifilament is not greater than 45 angstrom, and the crystal size in (100) planes thereof is not greater than 45 angstrom.

39. The fabric of claim 33, wherein the individual filament thickness of the at least one high elongation multifilament is 1 to 3 denier.

40. The fabric of claim 33, wherein the difference in length of the at least one high elongation multifilament and the at least one low elongation multifilament is 3 to 10% based on the length of the at least one low elongation multifilament.

41. The fabric of claim 32, wherein the fabric is a bulky fabric produced by a relax treatment in hot water at a temperature of at least 80° C., followed by a dry heat treatment at a temperature of at least 120° C.

* * * * *